US008682183B2

(12) United States Patent
Tanaka

(10) Patent No.: US 8,682,183 B2
(45) Date of Patent: Mar. 25, 2014

(54) IMAGE FORMING APPARATUS CAPABLE OF CORRECTING IMAGE DENSITY PROMPTLY ACCORDING TO CHANGE IN TONER DENSITY, AND METHOD OF CONTROLLING THE IMAGE FORMING APPARATUS

(75) Inventor: Sumito Tanaka, Tokyo (JP)

(73) Assignee: Canon Kabushiki Kaisha (JP)

( * ) Notice: Subject to any disclaimer, the term of this patent is extended or adjusted under 35 U.S.C. 154(b) by 269 days.

(21) Appl. No.: 13/108,412

(22) Filed: May 16, 2011

(65) Prior Publication Data

US 2011/0280594 A1 Nov. 17, 2011

(30) Foreign Application Priority Data

May 17, 2010 (JP) ..... 2010-113126
May 9, 2011 (JP) ..... 2011-104368

(51) Int. Cl.
*G03G 15/08* (2006.01)

(52) U.S. Cl.
USPC ..... 399/27; 399/49; 399/61

(58) Field of Classification Search
USPC ..... 399/9, 27–30, 38, 46, 49, 58, 61–65
See application file for complete search history.

(56) References Cited

U.S. PATENT DOCUMENTS 7,769,309 B2 * 8/2010 Tomita et al. ..... 399/49
7,831,159 B2 * 11/2010 Ishida ..... 399/27
8,036,554 B2 * 10/2011 Tenjiku ..... 399/49
8,045,874 B2 * 10/2011 Yoshida et al. ..... 399/49

FOREIGN PATENT DOCUMENTS

JP 2007-078896 A 3/2007

* cited by examiner

*Primary Examiner* — Hoan Tran
(74) *Attorney, Agent, or Firm* — Rossi, Kimms & McDowell LLP

(57) ABSTRACT

An image forming apparatus capable of correcting image density promptly. A developing device supplies toner to an electrostatic latent image on a photosensitive drum by development contrast potential to form a toner image. An image density sensor detects the density of a patch image on the photosensitive drum. A toner density sensor detects the toner density of developer in the developing device. The amount of toner supplied for replenishment is adjusted when the detected toner density is above a predetermined upper limit value or below a predetermined lower limit value. Further, when the detected patch image density is above a predetermined upper limit value, toner replenishment control is switched to development contrast control to increase image density. When the detected patch image density is below a predetermined lower limit value, the toner replenishment control is switched to the development contrast control to reduce image density.

2 Claims, 9 Drawing Sheets

IMAGE FORMING APPARATUS CAPABLE OF CORRECTING IMAGE DENSITY PROMPTLY ACCORDING TO CHANGE IN TONER DENSITY, AND METHOD OF CONTROLLING THE IMAGE FORMING APPARATUS

BACKGROUND OF THE INVENTION

1. Field of the Invention

The present invention relates to an image forming apparatus, such as a copying machine or a printer, using electrophotography, and a method of controlling the image forming apparatus.

2. Description of the Related Art

In general, in an electrophotographic image forming apparatus, a photosensitive surface of an image bearing member, such as a photosensitive member, is uniformly charged by an electrostatic charger, and an electrostatic latent image corresponding to image information is formed on the charged photosensitive surface by a latent image forming unit. Then, the electrostatic latent image is developed by a developing device using a developer and transferred onto a recording sheet by a transfer unit, whereby an image is formed.

In the image forming apparatus, the density and density gradation characteristics of an output image are sometimes different from those of an original image due to influence e.g. of a short-term change caused by a change in an environment where the apparatus is installed or an environmental change within the apparatus, or a long-term change caused by aging (degradation) of the photosensitive member or the developer.

Therefore, in the image forming apparatus, it is necessary to correct image forming conditions, as required, by taking into account the above-mentioned various changes, so as to make the density and density gradation characteristics of an output image equal to those of an original image.

In an image forming apparatus of the above-mentioned type, the toner density of two-component developer (the ratio of a toner weight (T) to the weight (D) of the total sum (developer) of a carrier and toner) is mentioned as one of very important factors required for stabilization of image quality. The toner density of developer decreases during development which consumes toner. For this reason, in the image forming apparatus, the toner density of developer or the density of a test image formed on a photosensitive member, an intermediate transfer member, or a recording sheet is detected using a density control device, i.e. a developer density control device or an image density control device. Then, the density control device replenishes a developing device with toner from a toner holder according to a change in the detected toner density of the developer or that of the pattern image. The toner density of the developer or the image density is held as constant as possible by this control, whereby an excellent image quality is maintained.

As an example of a method of controlling toner density, there has been proposed the developer reflection ATR (auto toner replenishment). A density control device using the developer reflection ATR optically detects the toner density of developer within a developing device by detecting an amount of reflected light from toner irradiated with light using a toner density sensor, and the amount of toner replenishment is controlled according to the result of the detection.

Further, as another example of the method of controlling toner density, there has been proposed the so-called patch detection ATR which detects the density of a pattern image. A density control device using the patch detection ATR forms an image density detection pattern image (patch image) for reference on an electrophotographic photosensitive member (photosensitive member). Then, the density of the pattern image is detected by a sensor, such as an image density sensor, disposed in facing relation to the photosensitive member, and the toner replenishment amount is controlled according to the result of the detection.

Furthermore, as a further example of the method of controlling toner density, there is proposed the so-called video count ATR. This method calculates the amount of toner to be consumed based on pixel-by-pixel output levels of a digital image signal from a video counter, and the amount of toner to be consumed is supplied for replenishment.

Each of the density control devices using the respective above-mentioned control methods controls the rotation or the like of a motor for driving a toner replenishment unit, whereby the amount of toner to be supplied for replenishment of developer within a developing device from a toner holder is controlled. Thus, the density control device holds the toner density of the developer or image density at a predetermined target density.

However, the above-described density control devices suffer from the following problems: First, in the case of the developer reflection ATR, the toner density of developer within a developing device is directly detected, which enables the toner density of the developer to be held constant. However, the frictional charge amount (triboelectric charge amount) of toner changes due to changes in the quality of a magnetic carrier in developer or environmental change, which causes a change in developing performance. For this reason, even if the toner density of the developer can be held constant, when the quality of the magnetic carrier or the environment changes, images are sometimes not formed with a desired density due to the fact that the toner charge amount does not become equal to a predetermined charge amount.

In the video count ATR, the density information of an original image is converted to a video count value, the amount of toner to be consumed is estimated based on the video count value, and toner corresponding in amount to a predicted change from an initial setting of the toner density of developer is supplied. For this reason, when the amount of actually consumed toner and the toner consumption amount estimated based on the video count value differ from each other, the difference occurs in the toner replenishment amount which should correspond to the amount of consumed toner. In such a case, the toner density of developer can deviate from its initial setting.

Further, in the case of the patch detection ATR, the control is performed by detecting the density of a patch image on a photosensitive member, so that image density can be maintained at a predetermined target value.

However, if the toner density is controlled by the patch detection ATR alone, there arises the following problems: If the amount of toner attached to the electrostatic latent image decreases due to a rise in frictional charge amount (triboelectric charge amount) under a low-humidity environmental condition, low patch image density is detected by the patch detection ATR, and therefore the control is performed such that toner replenishment is continued. When the toner/developer ratio is high, if the toner replenishment is carried out based on the result of patch detection ATR, the developing device is overfilled with toner by excessive toner replenishment, which causes overflow of developer or fogging.

On the other hand, if the amount of toner attached to the electrostatic latent image increases due to a fall in frictional charge amount (triboelectric charge amount) under a high-humidity environmental condition, a high patch image density is detected by the patch detection ATR, and therefore the control is performed such that the inhibition of toner replenishment is continued. When the toner/developer ratio is low, if the toner replenishment is inhibited based on the result of patch detection ATR, the amount of toner in the developing device decreases to reduce the amount of coating of developer on the developer bearing member, which can cause degradation of images.

To overcome the problems, the toner density is controlled to be as uniform as possible by the developer reflection ATR or the video count ATR and at the same time, the toner density is controlled based on the patch detection ATR such that an output image is formed which has a desired density (desired maximum density and desired gradation characteristics)

A conventional image forming apparatus performs image formation while restricting the control of the toner density of developer by the ATR control (see e.g. Japanese Patent Laid-Open Publication No. 2007-78896). In the conventional image forming apparatus, based on a toner density of developer detected by the developer reflection ATR and an image density of a patch formed by the patch detection ATR, it is determined whether or not the result of the patch detection ATR is to be reflected on the toner density control. Further, the toner density control is performed based on the results of the developer reflection ATR and the video count ATR without causing the result of the patch detection ATR to be reflected, and at the same time, the control of the image contrast potential for suppressing density variations of output images is performed. Here, the development contrast potential indicates the potential difference between the potential of a DC current component of the developing bias and the light area potential (image area potential) on the photosensitive member. In the conventional image forming apparatus, if the toner/developer ratio detected by the developer reflection ATR is equal to or larger than a predetermined value, and at the same time the image density detected by the patch detection ATR is not within a predetermined range and hence the image is darker than it should be, the development contrast potential is controlled to be increased. If the toner/developer ratio detected by the developer reflection ATR is lower than the predetermined value, and at the same time the image density detected by the patch detection ATR is not within a predetermined range and hence the image is lighter than it should be, the development contrast potential is controlled to be reduced. This makes it possible to adjust the image density to a desired value when the toner/developer ratio is not proper.

In other words, when the toner/developer ratio is at an upper or lower limit of its proper range, the conventional image apparatus performs the control such that a detection result of the variation in the density of an output image is fed back to the development contrast potential.

SUMMARY OF THE INVENTION

The present invention provides an image forming apparatus which is capable of correcting image density promptly when a change in the patch image density is detected, to thereby stably form a high-quality image, and a method of controlling the image forming apparatus.

In a first aspect of the present invention, there is provided an image forming apparatus comprising an image bearing member configured to have an electrostatic latent image formed thereon, a developing device configured to supply toner to the electrostatic latent image on the image bearing member by development contrast potential for generating a potential difference between the developing device and the electrostatic latent image, to thereby form a toner image, a toner replenishment unit configured to replenish the developing device with toner, an image density detection unit configured to detect a density of a reference toner image for image density control, which is formed by developing a reference electrostatic latent image for image density control formed on the image bearing member, by the developing device, a toner density detection unit configured to detect a toner density of developer in the developing device, a toner replenishment control unit configured to perform control such that an amount of toner replenishment by the toner replenishment unit is adjusted when a detection result from the toner density detection unit is more than an upper toner replenishment restriction limit value for use in restricting toner replenishment or when the detection result from the toner density detection unit is less than a lower toner replenishment restriction limit value for use in restricting toner replenishment, and an image density control unit configured to perform control such that when a detection result from the image density detection unit is more than an upper control switching limit value set below the upper toner replenishment restriction limit value for use in restricting toner replenishment, toner replenishment control is switched to development contrast control to increase image density, and when the detection result from the image density detection unit is less than a lower control switching limit value set above the lower toner replenishment restriction limit value for use in restricting toner replenishment, the toner replenishment control is switch to the development contrast control to reduce image density.

In a second aspect of the present invention, there is provided a method of controlling an image forming apparatus including an image bearing member configured to have an electrostatic latent image formed thereon, a developing device configured to supply toner to the electrostatic latent image on the image bearing member by development contrast potential for generating a potential difference between the developing device and the electrostatic latent image, to thereby form a toner image, a toner replenishment unit configured to replenish the developing device with toner, an image density detection unit configured to detect a density of a reference toner image for image density control, which is formed by developing a reference electrostatic latent image for image density control formed on the image bearing member, by the developing device, a toner density detection unit configured to detect a toner density of developer in the developing device, a toner replenishment control unit configured to drive the toner replenishment unit based on a detection result from the toner density detection unit to thereby perform toner replenishment, and an image density control unit configured to perform control by switching between toner replenishment control and development contrast control, based on a detection result from the image density detection unit, to adjust image density, the method comprising adjusting toner replenishment by the toner replenishment control unit when the detection result from the toner density detection unit is more than an upper toner replenishment restriction limit value for use in restricting toner replenishment, adjusting toner replenishment by the toner replenishment control unit when the detection result from the toner density detection unit is less than a lower toner replenishment restriction limit value for use in restricting toner replenishment, switching, when a detection result from the image density detection unit is more than an upper control switching limit value set below the upper toner replenishment restriction limit value for use in restricting toner replenishment, toner replenishment control to development contrast control to increase image density, and switching, when the detection result from the image density detection unit is less than a lower control switching limit value set above the lower toner replenishment restriction limit value for use in restricting toner replenishment, the toner replenishment control to the development contrast control to reduce image density.

According to the present invention, it is possible to stabilize the image density in a region (replenishment control restricted region) where toner replenishment control is restricted based on detected toner density of developer.

Further features of the present invention will become apparent from the following description of an exemplary embodiment with reference to the attached drawings.

DETAILED DESCRIPTION OF THE EMBODIMENTS

The present invention will now be described in detail below with reference to the accompanying drawings showing an embodiment thereof.

Figure 1:
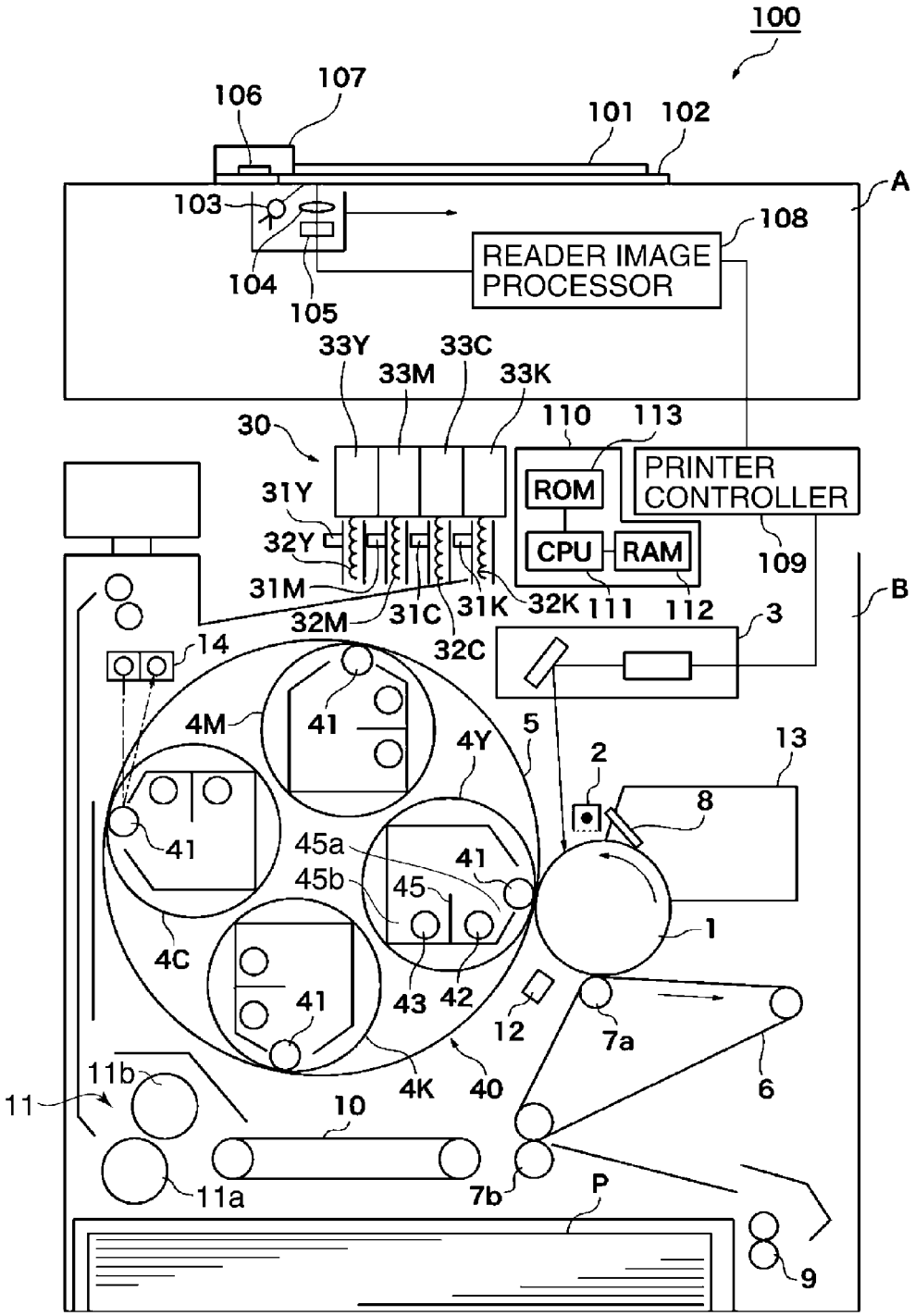
FIG. 1 is a schematic view of an image forming apparatus according to an embodiment of the present invention.

First, a description will be given of the whole arrangement and operation of an image forming apparatus according to an embodiment of the present invention. FIG. 1 is a schematic longitudinal cross-sectional view of the image forming apparatus. The image forming apparatus 100 of the present embodiment is an electrophotographic full four-color printer. The image forming apparatus 100 comprises a reader section (reader unit) A and a printer section B.

In the reader section A, a reference numeral 101 denotes an original, a reference numeral 102 denotes an original platen glass, a reference numeral 103 denotes a light source, a reference numeral 104 denotes an optical system, a reference numeral 105 denotes a CCD sensor, a reference numeral 106 denotes a reference white plate, and a reference numeral 107 denotes an abutment member. Image signals obtained by the CCD sensor 105 of the reader section (reader unit) A are subjected to image processing by a reader image processor 108, and are then delivered to the printer section B, wherein the signals are subjected to image processing by a printer controller (printer image processor) 109.

Figure 2:
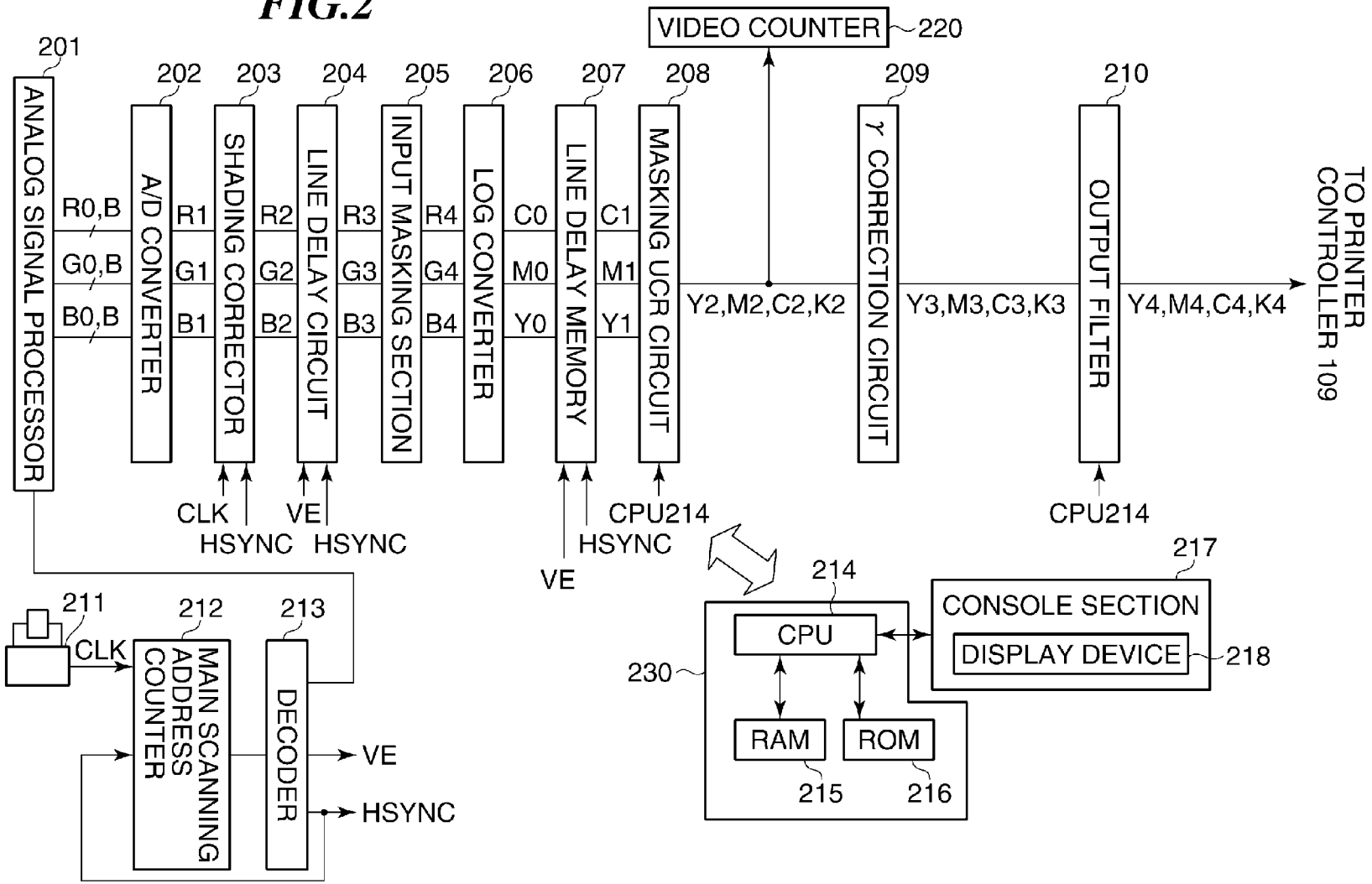
FIG. 2 is a diagram useful in explaining flows of image signals in a reader image processor of the image forming apparatus in FIG. 1.

The reader image processor 108 is configured as shown in a block diagram of FIG. 2 illustrating flows of image signals. In FIG. 2, a reference numeral 201 denotes an analog signal processor, a reference numeral 202 denotes an A/D converter, and a reference numeral 203 denotes a shading corrector. Further, in FIG. 2, a reference numeral 211 denotes a clock generator, a reference numeral 212 denotes a main scanning address counter, and a reference numeral 213 denotes a decoder. A reference numeral 204 denotes a line delay circuit, a reference numeral 205 denotes an input masking section, a reference numeral 206 denotes a light amount/image density converter (LOG converter), a reference numeral 207 denotes a line delay memory, and a reference numeral 208 denotes a masking UCR circuit. Furthermore, a reference numeral 209 denotes γ correction circuit, a reference numeral 210 denotes a space filter processor (output filter), and a reference numeral 220 denotes a video counter.

The γ correction circuit 209 of the reader section (reader unit) A performs image density correction so as to match image signals to ideal gradation characteristics of the printer section B. The γ correction circuit 209 performs density conversion using a LUT (gradation correction table) formed e.g. by 256 bytes of RAM. The space filter processor (output filter) 210 performs edge emphasis processing or smoothing processing. M2, C2, Y2, and K2 signals are also delivered to the video counter 220, and the video counter 220 adds up pixel-by-pixel image density values, thereby calculating a video count value of each image.

Frame-sequential M4, C4, Y4, and k4 image signals processed as above by the reader section (reader unit) A are delivered to the printer controller 109 of the printer section B. Then, the printer section B performs recording of an image having density gradation by PWM (pulse width modulation). More specifically, a pulse width modulation circuit 191 (see FIG. 4) of the printer controller 109 generates laser driving pulses each having a width (time width) corresponding to the level of an associated input pixel image signal, in association with respective input pixel image signals, and outputs the laser driving pulses. Further specifically, the width modulation circuit 191 generates a drive pulse of a larger width in association with a higher-density pixel image signal, a drive pulse of a smaller width in association with a lower-density pixel image signal, and a drive pulse of an intermediate width in association with an intermediate-density pixel image signal. Each of the laser driving pulses output from the width modulation circuit 191 is supplied to a semiconductor laser of a laser scanner 3 as an exposure unit to cause the semiconductor laser to emit a laser beam corresponding in time to the width of the laser driving pulse. As a consequence, the semiconductor laser is driven for a longer time for a higher-density pixel, and for a shorter time for a lower-density pixel.

For this reason, an optical system provided in the laser scanner 3 irradiates light to a longer area in the main scanning direction on a photosensitive drum 1, referred to hereinafter, for a higher-density pixel, and to a shorter area in the main scanning direction for a lower-density pixel. In short, electrostatic latent images differ in dot size according to pixel density. Thus, toner consumption for higher-density pixels is larger than toner consumption for lower-density pixels.

As shown in FIG. 2, in the image forming apparatus 100, the overall operation of the reader section A is controlled by a controller 230 including a CPU 214, a RAM 215, and a ROM 216. On the other hand, as shown in FIG. 1, the overall operation of the printer section B is controlled by a controller 110. Further, the main unit of the image forming apparatus 100 is provided with a console section 217 including a display device 218 as shown in FIG. 2. The console section 217 is connected to the CPU 214 of the reader section A, a CPU 111 of the controller 110 of the printer section B, etc. and is configured to be capable of receiving instructions input by a user.

Figure 3:
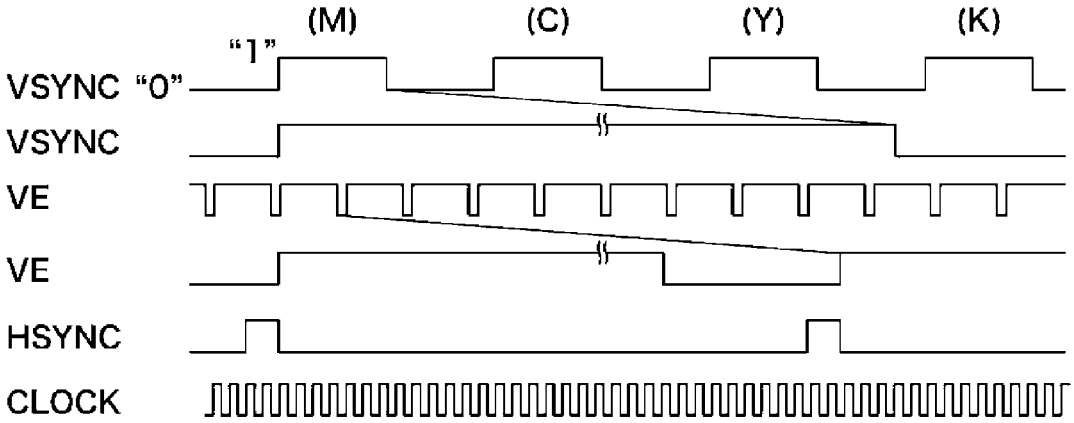
FIG. 3 is a timing diagram of control signals in the reader image processor of the image forming apparatus shown in FIG. 1.

In the reader image processor 108 of the reader section A of the image forming apparatus 100, each control signal is controlled in timing shown in FIG. 3. In FIG. 3, a VSYNC signal is an effective image section signal in the sub scanning direction. Image reading (scanning) is performed over a section where the VSYNC signal has a logic 1 value, whereby output signals M, C, Y, and k are sequentially formed. A VE signal is an effective image section signal in the main scanning direction. Timing of a main scanning start position is determined by a section where the VE signal has a logic 1 value, and the VE signal is basically used for performing line counting control for line delay. A CLOCK signal is a pixel synchronizing signal, and is used to transmit image data in rise timing from a logic 0 value to a logic 1 value.

Next, a description will be given of the printer section B of the image forming apparatus 100. In the image forming apparatus 100, the user operates the console section 217 to input print conditions, such as an image type and a sheet count. The printer section B performs image formation according to instructions from the user.

The image forming apparatus 100 has the photosensitive drum 1 as a drum-shaped electrophotographic photosensitive member which functions as an image bearing member. The photosensitive drum 1 is rotated by a drive unit (not shown) in a direction (counterclockwise direction) indicated by an arrow in FIG. 1. During the rotation, the surface of the photosensitive drum 1 is uniformly charged by a primary electrostatic charger 2 as a primary charging unit. In the image forming apparatus 100, the primary electrostatic charger 2 is implemented by a scorotron charger. The scorotron charger comprises a wire to which a high voltage is applied, a grounded shield section, and a grid section to which a desired voltage is applied. Applied to the wire of the primary electrostatic charger 2 is a predetermined charge bias from a charge bias power supply (not shown) as a charge bias output unit. Applied to the grid section of the primary electrostatic charger 2 is a predetermined grid bias from a grid bias power supply 21 (see FIG. 4) as a grid bias output unit. The photosensitive drum 1 is substantially charged with the voltage applied to the grid section, which is dependent on the voltage applied to the wire.

The photosensitive drum 1 the surface of which is thus charged is irradiated with a laser beam by the exposure device (laser scanner) 3 as an exposure unit (image writing unit) according to an image pattern of a first color (yellow, for example). Thus, an electrostatic latent image for the first-color image is formed on the surface of the photosensitive drum 1. The laser scanner 3 outputs a laser beam according to a drive signal (laser output signal) generated using the gradation correction table (LUT) of the γ correction circuit 209 such that a desired image density level can be obtained. Based on a relationship which is determined in advance between the laser output signal and the image density level, values of the laser output signal that can generate respective desired image densities are stored in the gradation correction table (LUT) of the γ correction circuit 209. The laser scanner 3 determines a value of the laser output signal according to the table.

The electrostatic latent image thus formed on the photosensitive drum 1 is developed by a rotary developing device 40. The rotary developing device 40 comprises developing units 4Y, 4M, 4C, and 4K for the respective colors of yellow, magenta, cyan, and black. Each of the developing units 4Y, 4M, 4C, and 4K is filled with two-component developer including an associated one of yellow, magenta, cyan, and black toners. As shown in FIG. 1, the developing units 4Y, 4M, 4C, and 4K are integrally mounted in a rotary support (rotary drum) 5.

The rotary developing device 40 rotates the rotary support 5 in timing synchronous with formation of an electrostatic latent image on the photosensitive drum 1, whereby a developing unit for an associated color of the electrostatic latent image is set in a position (development position) opposed to the photosensitive drum 1 prior to development. Then, in the present example, the electrostatic latent image formed on the photosensitive drum 1 for a yellow image is developed in accordance with rotation of the photosensitive drum 1 by the yellow developing unit 4Y set in advance in facing relation to the photosensitive drum 1, into a yellow visualized image (toner image).

The yellow toner image thus formed on the photosensitive drum 1 is transferred (primarily transferred) onto an intermediate transfer belt 6 which is a belt-like intermediate transfer member by the action of a primary transfer roller 7*a* as a primary transfer unit. At this time, primary transfer bias opposite in polarity to the normal charging polarity of the toner is applied to the primary transfer roller 7*a* by a primary transfer bias power supply (not shown) as a primary transfer bias output unit. At the same time, the intermediate transfer belt 6 circularly moves (rotates) in a direction indicated by an arrow in FIG. 1 (i.e. a clockwise direction as viewed in FIG. 1) at substantially the same speed as the photosensitive drum 1, whereby the transfer (primary transfer) is performed.

The rotary developing device 40 performs the above-described processing steps of electrostatic charging, exposure, development, and primary transfer for each of the colors of magenta, cyan, and black in the mentioned order, following the color of yellow. Thus, a full-color toner image of the superimposed color toner images is formed on the intermediate transfer belt 6.

Then, the four-color toner images superimposed on the intermediate transfer belt 6 are transferred (secondarily transferred) onto a transfer material P in a single operation by the action of a secondary transfer roller 7*b* as a secondary transfer unit. At this time, secondary transfer bias opposite in polarity to the normal charging polarity of the toners is applied to the secondary transfer roller 7*b* by a secondary transfer bias power supply (not shown) as a secondary transfer bias output unit. At the same time, the transfer material P is conveyed to a contact portion between the intermediate transfer belt 6 and the secondary transfer roller 7*b* in predetermined timing by a transfer material conveying unit including a pickup roller 9, and is subjected to transfer processing.

The transfer material P having the four-color toner image transferred thereon is conveyed to a fixing device 11 by a conveyance belt 10. In the fixing device 11, the transfer material P is held between a fixing roller 11*a* provided with a heating unit, not shown, and a pressing roller 11*b* in pressure contact with the fixing roller 11*a*, and heated and pressed while being moved by rotation of the rollers 11*a* and 11*b*, whereby toner is fused and fixed on the transfer material P to fixedly form a final full-color image. After the toner image is thus heated and fixed on the transfer material P, the transfer material P having the final full-color image formed thereon is discharged out of the apparatus.

Thereafter, toner remaining on the photosensitive drum 1 after the primary transfer is scraped off by a cleaning blade 8 of a cleaner 13 as a cleaning unit, and is collected by the cleaner 13.

Although in the above description, a full-color image is formed by way of example, the image forming apparatus 100 is also capable of forming a monochrome image, such as a black monochrome one. In this case, an electrostatic latent image formed on the photosensitive drum 1 for an image of a desired color is developed by a developing unit for the desired color. Further, in this case, a toner image of the desired color formed on the photosensitive drum 1 is finally transferred onto a transfer material P and then the transfer material P is subjected to fixing processing, whereby the monochrome image of the desired color is formed.

Now, a detailed description will be given of the developing units 4Y, 4M, 4C, and 4K. It should be noted that in the present embodiment, the developing units 4Y, 4M, 4C, and 4K are substantially identical in construction and operation except that used toners are different in color. Therefore, in the following, the suffixes Y, M, C, and K added to the reference numeral 4 to represent the respective different colors are omitted unless specifically required, and the developing units 4Y, 4M, 4C, and 4K will be generically referred to as "the developing unit 4".

The developing unit 4 used in the present embodiment employs a two-component development system using two-component developer. The developing unit 4 is in the development position opposed to the photosensitive drum 1 during execution of development processing. The inner space of the developing unit 4 is partitioned into a first chamber (development chamber) 45*a* and a second chamber (stirring chamber) 45*b* by a partition wall 45 extending vertically when the developing unit 4 is in the development position. In the first chamber, there is disposed a developing sleeve 41 of a non-magnetic material, as a developer carrier. Within the developing sleeve 41, there is fixedly disposed a magnet, not shown, as a magnetic field generating unit.

In the first chamber 45*a* and the second chamber 45*b*, there are disposed first and second screws 42 and 43, as respective developer stirring conveyance units. The first screw 42 stirs and conveys developer in the first chamber. The second screw 43 stirs and conveys toner supplied from a toner replenishment tank 33 by rotation of a toner conveyance screw 32, and a developer already existing in the developing unit, to thereby make the toner density of the developer uniform. The partition wall 45 between the first chamber 45*a* and the second chamber 45*b* has front and rear ends thereof, as viewed in FIG. 1, formed with respective developer passages for communication between the two chambers.

In the developing unit 4 constructed as above, when toner is consumed for development to cause the toner density of developer in the first chamber 45*a* to lower, the developer having its toner density reduced is moved through one of the passages into the second chamber 45*b* by conveyance forces of the first and second screws 42 and 43. Further, developer having its toner density recovered in the second chamber 45*b* is moved through the other of the passages into the first chamber 45*a*.

The two-component developer in the developing unit 4 is carried on the developing sleeve 41 by the magnetic force of the magnet. Then, the developer on the developing sleeve 41 has its layer depth made uniform by a blade, not shown, as a developer regulating member, and is conveyed to a development area opposed to the photosensitive drum 1 in accordance with rotation of the developing sleeve 41. In the development area, the developer is used to develop an electrostatic latent image on the photosensitive drum 1.

In the developing unit 4, a predetermined developing bias is applied to the developing sleeve 41 from a developing bias power supply 44 (see FIG. 4) as a developing bias output unit so as to improve development efficiency (rate of toner addition to a latent image). Further, a developing bias voltage obtained by superposing a DC voltage on an AC voltage is applied to the developing sleeve 41 from the developing bias power supply 44.

The developing units 4Y, 4M, 4C, and 4K constructed as above are replenished with toners from the respective toner replenishment tanks 33Y, 33M, 33C, and 33K. The toner replenishment tanks 33Y, 33M, 33C, and 33K are arranged above the rotary developing device 40.

Each of the toner replenishment tanks 33Y, 33M, 33C, and 33K contains respective toners for replenishment. Below the toner replenishment tanks 33Y, 33M, 33C, and 33K, there are disposed the toner conveyance screws 32Y, 32M, 32C, and 32K driven by respective motors 31Y, 31M, 31C, and 31K as drive sources.

Each of the toner conveyance screws 32Y, 32M, 32C, and 32K conveys an associated toner for replenishment through a toner conveying path (not shown) to supply the toner to an associated one of the developing units 4Y, 4M, 4C, and 4K. The CPU 111 of the control unit 110 controls toner supply by each of the toner conveyance screws 32Y, 32M, 32C, and 32K by controlling rotation of an associated one of the motors 31Y, 31M, 31C, and 31K via a motor drive circuit (not shown). For this reason, a RAM 112 connected to the CPU 111 stores control data and the like to be supplied to the motor drive circuit.

The toner replenishment tanks 33Y, 33M, 33C, and 33K, the motors 31Y, 31M, 31C, and 31K, and the toner conveyance screws 32Y, 32M, 32C, and 32K form a toner replenishment unit 30. It should be noted that the members of the toner replenishment unit 30 for the respective colors are substantially identical in construction and operation except that the toners for replenishment are different in color from each other.

When the developing processing for an electrostatic latent image is performed as described above, toner is consumed and the toner density of developer within the developing unit 4 lowers. For this reason, in the present embodiment, a density control device 300 performs control (toner replenishment control) for replenishing the developing unit 4 with toner from the toner replenishment tank 33. In the toner replenishment control, the toner density of developer is controlled such that it is as constant as possible or such that the image density based on image data is made as equal as possible to a predetermined target value at each gradation level.

The density control device 300 of the image forming apparatus 100 is configured to be capable of performing the toner replenishment control by the method of patch detection ATR in which a patch image is formed for reference on the photosensitive drum 1 and the density of the patch image is detected by an image density sensor (patch detection ATR sensor) 12 disposed in facing relation to the photosensitive drum 1, for control of the toner density. Further, the density control device 300 is configured to be capable of also performing the toner replenishment control by the method of developer reflection ATR in which the toner density of developer in the developing unit 4 is detected by a toner density sensor (developer reflection ATR sensor) 14, for control of the toner density. Furthermore, the density control device 300 is configured to be capable of also performing the toner replenishment control by the method of video count ATR in which the amount of required toner, i.e. the amount of toner to be consumed is calculated based on the pixel-by-pixel output levels of the digital image signal from the video counter 220, for control of the toner density.

As described above, the image forming apparatus 100 executes toner replenishment control using the density control device 300 which employ the three methods. In the patch detection ATR, a change in the density of a predetermined output image (patch image) is detected using the image density sensor 12 as an image density detection unit, and toner replenishment control is performed based on the result of the detection. The patch formation is performed whenever image formation is performed on a predetermined number of sheets of recording material (e.g. every 24 sheets). In the developer reflection ATR, the toner density of developer in the developing unit 4 is directly detected using the toner density sensor 14 as a toner density detection unit, and toner replenishment control is performed based on the result of the detection. In the video count ATR, toner replenishment control is performed based on a toner consumption amount estimated from a video count value obtained using the video counter 220 as a toner density detection unit. The operations of the toner density control 300 based on the respective methods will be described in detail hereinafter.

Figure 4:
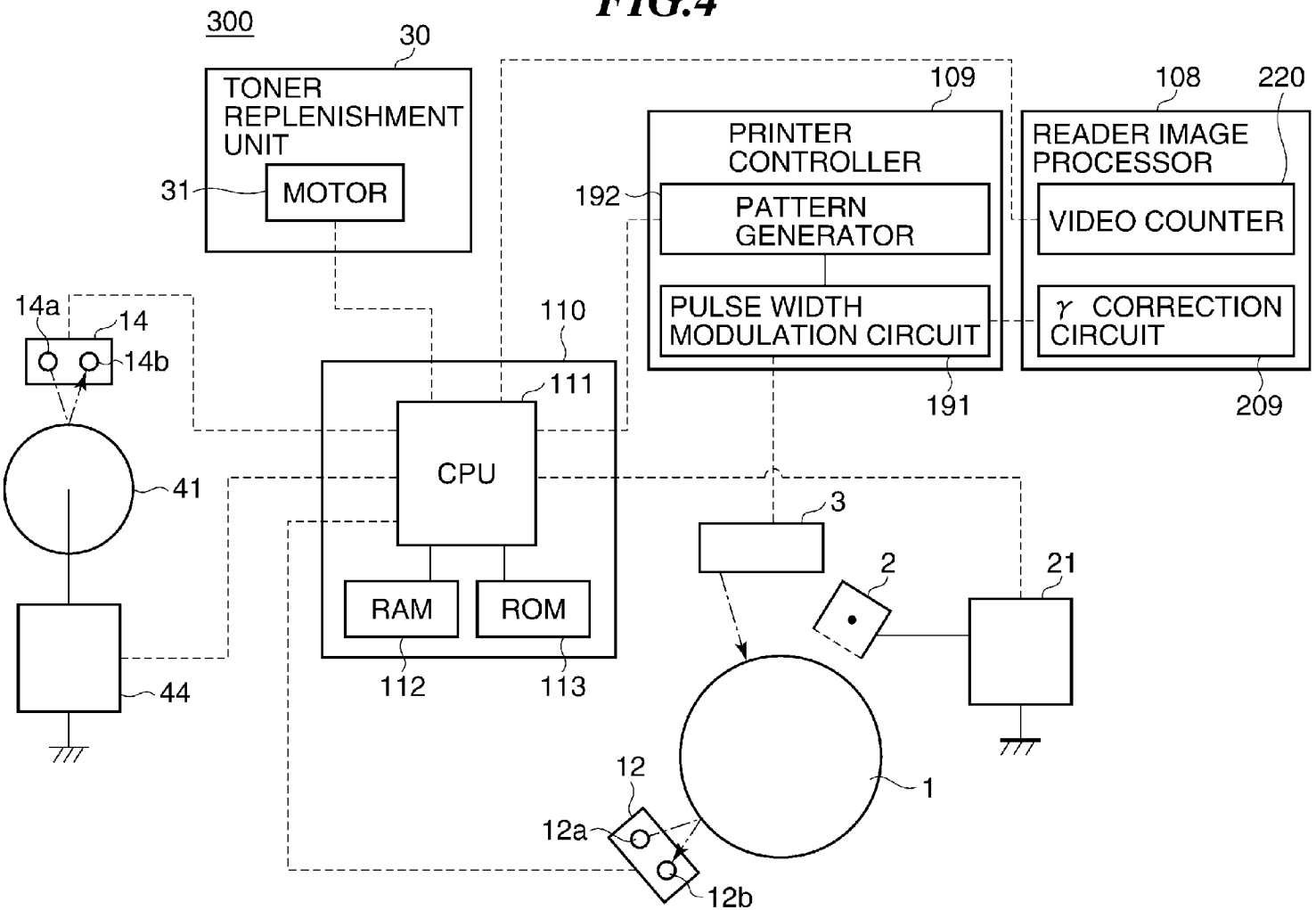
FIG. 4 is a schematic control block diagram of essential parts of the image forming apparatus associated with toner replenishment control.

Next, a description will be given of control by the density control device 300 in the image forming apparatus 100 with reference to FIG. 4.

The density control device 300 of the image forming apparatus 100 includes the controller 110 that controls the overall operation of the printer section B. The controller 110 comprises the CPU 111, the RAM 112, and a ROM 113. The controller 110 also functions as a development contrast potential control unit, described hereinafter. The controller 110 especially controls each of the motors 31 for controlling a toner replenishment amount, based on signals from the toner density sensor 14, the image density sensor 12, and the video counter 220 (see FIG. 2). Then, the controller 110 controls the grid bias power supply 21 that outputs grid bias to the primary charger 2 and the developing bias power supply 44 that outputs developing bias to the developing sleeve 41 of the developing unit 4, to thereby control the development contrast potential.

In the image forming apparatus 100, a reference electrostatic latent image formed on the photosensitive drum 1 for image density control is developed by the developing unit 4, whereby a reference toner image (patch image, toner pattern) for image density control is formed on the photosensitive drum 1. The image density sensor 12 includes a light emitter 12*a* having a light emitting device, such as an LED, and a light receiver 12*b* having a light receiving element, such as a photodiode (PD). In the present image forming apparatus 100, light is irradiated onto the reference toner image (patch image) for image density control from the light emitter 12*a*, and a reflected light from the reference toner image is received by the light receiver 12*b*. The CPU 111 detects a density of the reference toner image from the amount of the reflected light received by the light receiver 12*b*.

Further, the image forming apparatus 100 has the toner density sensor 14 and the video counter 220 as the toner density detection unit for detecting the toner density of developer in the developing unit 4. The image forming apparatus 100 performs toner replenishment operation for replenishing the developing unit 4 with toner from the toner replenishment unit 30, at least based on a detection result from the toner density sensor detection unit 14 (the toner density sensor) or 220 (the video counter).

Furthermore, the controller 110 has a function of switching between the control of development contrast potential, the control of toner replenishment, and the control of development contrast potential and toner replenishment, according to a toner density detection result and a patch image density detection result.

The controller 110 of the image forming apparatus 100 is capable of switchingly performing the control of development contrast potential and the control of toner replenishment operation according to a detection result from the toner density detection unit 14 or 220 and a detection result from the image density detection unit 12 (the image density sensor).

Next, a description will be given of image density detection and image gradation control performed during continuous image forming operation.

Figure 6:
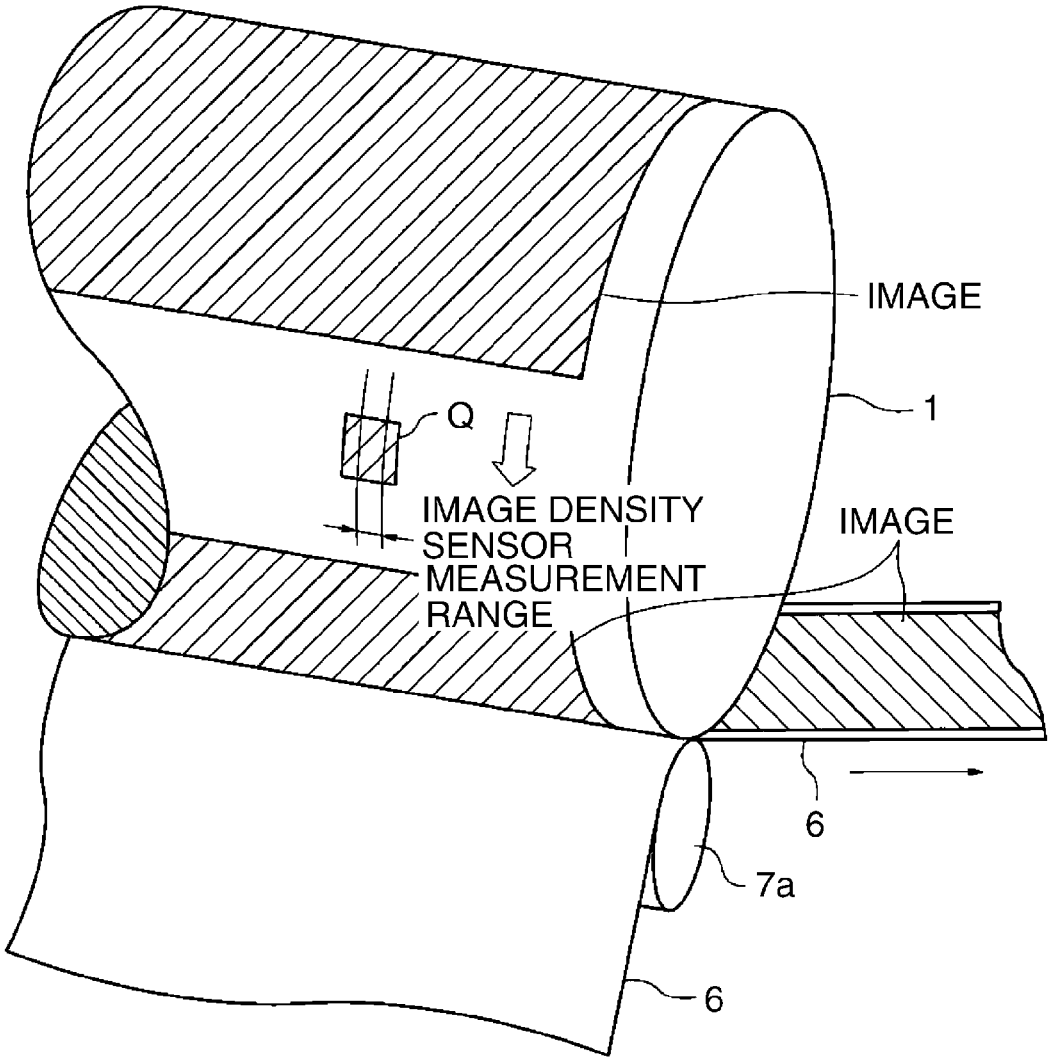
FIG. 6 is a schematic view useful in explaining a patch image forming method executed by the image forming apparatus.

First, the patch detection ATR is described. First, during continuous image forming operation, the CPU 111 forms an image density detection image pattern (patch image) Q in a non-image area on the photosensitive drum 1 defined between the leading end of an output image and the trailing end of the same, as shown in FIG. 6. It should be noted that an electrostatic latent image for a patch image will be hereafter referred to as "a patch latent image". In order to form a patch latent image, the printer controller 109 is provided with a patch image signal generation circuit (pattern generator) 192 for generating a patch image signal having a signal level corresponding to a predetermined density, as shown in FIG. 4.

The printer controller 109 delivers a patch image signal from the pattern generator 192 to the pulse width modulation circuit 191 and causes the pulse width modulation circuit 191 to generate a laser drive pulse having a pulse width corresponding to the predetermined density. Then, the printer controller 109 delivers the laser drive pulse to the semiconductor laser of the laser scanner 3 and causes the semiconductor laser to emit a laser beam over a time period corresponding to the pulse width to scan and expose the photosensitive drum 1. Thus, a patch latent image corresponding to the predetermined density is formed on the photosensitive drum 1. Then, the patch latent image is developed by the developing unit 4. The amount of reflected light from the thus formed patch image Q on the photosensitive drum 1 is detected by the image density sensor 12 as the image density detection unit.

The image density sensor 12 measures the amount of reflected light in timing synchronous with passage of the patch image Q formed in the non-image area on the photosensitive drum 1 below the image density sensor 12. A signal indicative of a result of the detection is input to the CPU 111. Thereafter, the CPU 111 calculates a correction amount (described hereinafter) of a toner replenishment amount estimated to provide a desired predetermined density (reflected light amount).

Figure 7:
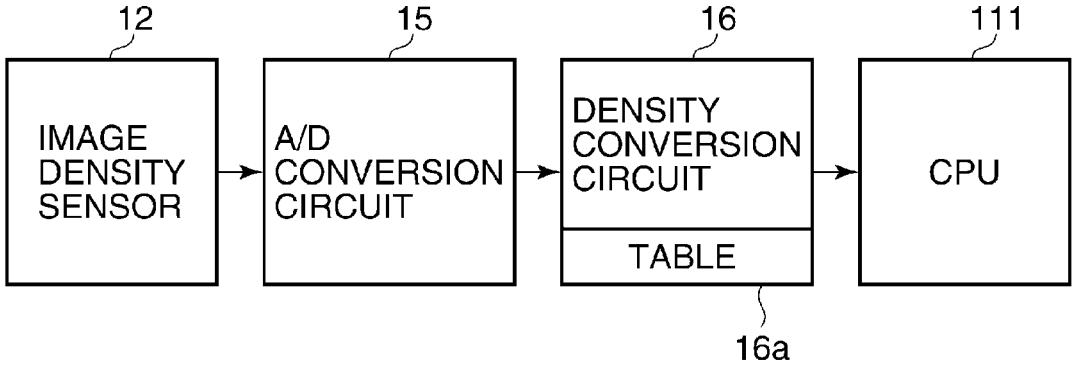
FIG. 7 is a block diagram illustrating the configuration of a circuit for processing output signals from an image density sensor provided in the image forming apparatus.

Next, a description will be given of specific means for measuring the amount of reflected light by the image density sensor 12 as the image density detection unit, with reference to FIG. 7. FIG. 7 is a block diagram illustrating the configuration of a circuit for processing output signals from the image density sensor 12.

Reflected light (near-infrared light) input to the image density sensor 12 from the photosensitive drum 1 is converted to an electric signal of 0 to 5V. The electric signal of 0 to 5V is converted to an 8-bit digital signal by an A/D conversion circuit 15 provided in the controller 110. Then, the digital signal is converted to density information by a density conversion circuit 16 provided in the controller 110.

In the present embodiment, it is assumed that each toner for use is formed by dispersing a coloring material of an associated color into a binder made of a styrene-based copolymer resin. The photosensitive drum 1 used in the present embodiment is an OPC (organic photoconductor) photosensitive member having its reflectance to near infrared light (960 nm) set to approximately 40%. It should be noted that the photosensitive drum 1 may be an amorphous silicon-based photosensitive member having the same reflectance as that of the OPC photosensitive member. The image density sensor 12 is configured to detect only regular reflection light from the photosensitive drum 1.

Figure 8:
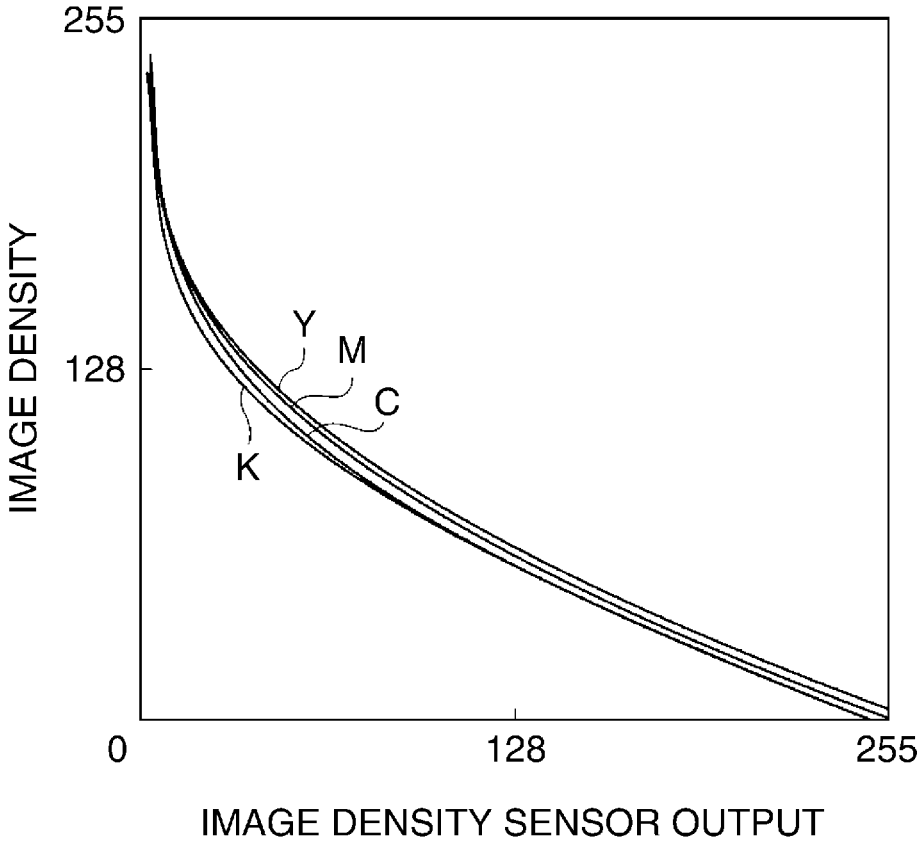
FIG. 8 is a graph showing the relationship between an output from the image density sensor and an output image density in a case where a patch image density is changed stepwise by the image forming apparatus.

The result of measurement of the reflected light amount by the image density sensor 12 as the image density detection unit can be obtained as curves illustrated in FIG. 8. FIG. 8 shows the relationship between the output from the image density sensor 12 and the output image density in a case where the density of the patch image Q on the photosensitive drum 1 is changed stepwise by area gradation for each color. It should be noted that the output from the image density sensor 12 in a state where no toner is attached to the photosensitive drum 1 is set to 5 V, i.e. level 255.

As shown in FIG. 8, as the area coverage ratio of each toner becomes higher to increase the image density, the output from the image density sensor 12 becomes smaller. Based on such characteristics of the image density sensor 12, color-specific tables 16*a* for converting respective output signals from the image density sensor 12 to density signals are formed in advance. The color-specific tables 16*a* are stored in a storage section of the density conversion circuit 16. Thus, the density conversion circuit 16 is capable of reading image density accurately on a color-by-color basis. The density conversion circuit 16 outputs the density information to the CPU 111.

It should be noted that in the present embodiment, a density signal having a range of 64 levels is used as a laser output for use in forming the patch image Q for each color. The laser output is determined using the gradation correction table (LUT), as described hereinbefore.

In the present embodiment, the patch image Q is formed in the non-image area during normal image forming operation, the density of the patch image Q is detected, and then the toner replenishment amount is caused to be corrected as required. As a consequence, ideally, the toner replenishment amount is corrected by toner replenishment control by the patch diction ATR such that the density signal of the patch image Q can be detected over a range of 64 levels.

However, the image characteristics of the image forming apparatus 100 can be changed at any time. For this reason, the density of the patch image Q cannot always be detected over the range of 64 levels by the image density sensor 12.

Therefore, based on a difference AD between a reference density signal from the patch image Q, which was obtained at an initial setting time, and a detection result, the CPU 111 reduces the toner replenishment amount when the difference ΔD indicative of an amount required for correction of the toner replenishment amount is positive, whereas when the difference ΔD is negative, the CPU 111 increases the toner replenishment amount.

The reference density signal is stored in the RAM 112. The use of the reference density signal makes it possible to secure excellent and constant density transition, though the density has some degree of ripple.

Next, a description will be given of toner replenishment control using the video count ATR. In the present embodiment, a toner replenishment amount Msum is calculated using the video count ATR and the patch detection ATR by the following equation (1):

$$\text{Toner replenishment amount } Msum = Mv + (Mp/\text{frequency of patch detection ATR}) \quad (1)$$

Mv: toner replenishment amount determined by the video count ATR

Mp: toner replenishment amount determined by the patch detection ATR

As described hereinabove, the value Mp (hereinafter referred to as "the replenishment correction amount") is calculated, using the detection value of the density of the patch image formed using the developer in the initial condition as the reference, from the difference ΔD between the reference density value and the result of the measurement. For example, a change amount ΔDrate is determined in advance as a change in the result of the measurement of the density of the patch image Q, which occurs when the amount of toner within the developing unit 4 deviates from a reference value thereof by an amount of 1 g (reference amount). The change amount ΔDrate is stored in the ROM 113. The CPU 111 calculates the replenishment correction amount Mp based on the change amount ΔDrate, by the following equation (2):

$$Mp = \Delta D/\Delta D\text{rate} \quad (2)$$

In the viewpoint of suppressing hue variation, it is ideal that the replenishment of toner corresponding in amount to the replenishment correction amount Mp is performed as evenly as possible during each interval of execution of the patch detection ATR. For this reason, the tone replenishment is executed by evenly dividing the replenishment correction amount Mp within the interval of execution of the patch detection ATR. Therefore, in the equation (1), the replenishment correction amount Mp is divided by the frequency of execution of the patch detection ATR. If the replenishment correction amount Mp is not divided by the frequency of execution of the patch detection ATR, toner replenishment control can be performed more than necessary e.g. when an image is to be formed on a first sheet after execution of the patch detection ATR, which can cause an overshoot.

The value Mv (hereinafter referred to as "basic replenishment amount") determined by the video count ATR is calculated based on image signals read by the reader section A or image signals sent from a computer or the like. The circuit for processing the image signals is configured as illustrated in the FIG. 2 block diagram.

The image signals are delivered to the video counter 220 as described hereinbefore. Then, pixel-by-pixel density values are added up by the video counter 220, whereby the video count value of an associated image is calculated.

The video count value is converted to the basic replenishment amount Mv using a table representative of the relationship between the video count value and the toner replenishment amount, which is determined in advance. The table is stored in the ROM 113. Thus, the basic replenishment amount Mv is calculated for each image whenever image formation is performed.

As described above, the CPU 111 of the controller 110 calculates the toner replenishment amount Msum by the aforementioned equation (1).

In short, in the present embodiment, an electrostatic latent image is formed on the photosensitive drum 1 by a digital method, and a toner replenishment operation is performed based on pixel-by-pixel output levels of the digital image signal for the electrostatic latent image formed on the photosensitive drum 1, while being corrected based on the result of detection by the image density sensor 12.

Next, the developer reflection ATR will be described. In the present embodiment, the developer reflection ATR is used to determine a toner density range (replenishment control restricted region) where toner replenishment control is restricted. The toner density sensor 14 as the toner density detection unit is disposed at a location for being opposed to the developing sleeve 41 of each developing unit 4. In the present embodiment, since the rotary support 5 carrying the developing units 4 rotates when one development color is to be changed to another, the developing unit 4 opposed to the toner density sensor 14 is also changed from one to another.

This enables the toner density sensor 14 to measure the toner density of developer in each of the developing units 4 for the respective colors. The toner density sensor 14 comprises a light emitter 14*a* having a light-emitting device, such as an LED, and a light receiver 14*b* having a light-receiving device, such as a photodiode (PD).

The CPU 111 calculates the toner density T/D (toner/developer ratio) of developer in each of the developing units 4 based on the result of detection by the toner density sensor 14 and so forth, by the following equation (3):

$$T/D=(SGNL\ \text{value}-SGNLi\ \text{value})/\text{Rate}+\text{initial}\ T/D \quad (3)$$

SGNL value: measured value of the toner density sensor

SGNLi value: initially measured value of the toner density sensor (initial value)

Further, Rate represents a sensitivity of ΔSGNL to T/D measured in advance as a characteristic of the toner density sensor 14. As the initial T/D and the SGNLi, values measured when initially installing the toner density sensor 14 are used, and the initial T/D, the SGNLi, and Rate are stored in the RAM 112 of the controller 110.

Toner replenishment control or toner replenishment control restriction in each range of the toner density T/D is performed as shown in Table 1.

TABLE 1

| | RESULT OF PATCH DETECTION ATR | | |
|---|---|---|---|
| TONER DENSITY | THIN | PROPER | THICK |
| A(T/D > 13%) | ATR ERROR | | |
| B(13% ≥ T/D > 12%) | STOP REPLENISHMENT | | |
| C(12% ≥ T/D > 11%) | VIDEO COUNT ATR ALONE (IGNORE PATCH RESULT) | NORMAL OPERATION | |
| D(11% ≥ T/D > 6%) | NORMAL OPERATION | | |
| E(6% ≥ T/D > 5%) | NORMAL OPERATION | | VIDEO COUNT ATR ALONE (IGNORE PATCH RESULT) |
| F(5% ≥ T/D > 4%) | EXECUTED FORCED REPLENISHMENT | | |
| G(4% > T/D) | ATR ERROR | | |

The toner replenishment control is performed based on the toner density T/D of developer, the basic replenishment amount Mv and the replenishment correction value Mp, e.g. according to Table 1.

More specifically, as shown in Table 1, when the toner density T/D exceeds 11% (in regions A, B, C), even if the image density is determined to be thin as a result of the patch detection ATR, there is a fear of overflow of toner or fogging if the toner density T/D is increased. Therefore, the CPU 111 restricts the toner replenishment. In the region C, if it is determined that the image density is determined to be thin by the patch detection ATR, the toner replenishment is executed by the video count ATR alone. In the region B, the toner replenishment is stopped irrespective of the result of the patch detection ATR. In the region A, irrespective of the result of the patch detection ATR, an ATR error is determined, and information indicating that the toner replenishment control is in trouble is notified to the user via the display device 218 of the console section 217 or the like.

Similarly, when the toner density T/D is lower than 6% (in regions E, F, G), even if the image density is determined to be thick as a result of the patch detection ATR, there is a fear of coating deficiency of developer if the toner density T/D is reduced. Therefore, the CPU 111 restricts the toner replenishment. In the region E, if it is determined that the image density is determined to be thick by the patch detection ATR, the toner replenishment is executed by the video count ATR alone. In the region F, the toner replenishment is stopped irrespective of the result of the patch detection ATR. In the region G, irrespective of the result of the patch detection ATR, an ATR error is determined, and information indicating that the toner replenishment control is in trouble is notified to the user via the display device 218 of the console section 217 or the like.

Here, "video count alone (ignore patch result)" means that Msum=Mv is set.

This makes it possible to obtain very excellent density transition in the region D. Further, in the regions B and C as well as the regions E and F, it is possible to control the toner replenishment such that the toner density T/D does not reach the region where the overflow of development or fogging, or the coating deficiency of developer on the developing sleeve 41 occurs, though there is variation in the density transition. Therefore, it is possible to prevent occurrence of an ATR error in the region A or G, and damage to the image forming apparatus 100 due to the toner replenishment control deficiency.

As described above, predetermined limits of the toner density TD are provided on the toner replenishment control, whereby there are defined regions (correction control restricted regions) wherein when the toner density TD exceeds either of the predetermined limits, the result of the detection of the density of the patch image Q by the patch detection ATR is not fed back to the toner replenishment control.

Table 2 shows how development contrast potential is conventionally controlled according to the toner density T/D and the result of the patch detection ATR.

TABLE 2

| | RESULT OF PATCH DETECTION ATR | | |
|---|---|---|---|
| TONER DENSITY | THIN | PROPER | THICK |
| A(T/D > 13%) | | — | |
| B(13% ≥ T/D > 12%) | INCREASE DEVELOPMENT CONTRAST | PROGRESSIVELY BRING DEVELOPMENT CONTRAST BACK WHEN \|α\| > 0, BUT DO NOT CHANGE DEVELOPMENT CONTRAST WHEN \|α\| = 0 | |
| C(12% ≥ T/D > 11%) | | | |
| D(11% ≥ T/D > 6%) | PROGRESSIVELY BRING DEVELOPMENT CONTRAST BACK WHEN \|α\| > 0, BUT DO NOT CHANGE DEVELOPMENT CONTRAST WHEN \|α\| = 0 | | |
| E(6% ≥ T/D > 5%) | PROGRESSIVELY BRING DEVELOPMENT CONTRAST BACK WHEN \|α\| > 0, BUT DO NOT CHANGE DEVELOPMENT CONTRAST WHEN \|α\| = 0 | | REDUCE DEVELOPMENT CONTRAST |
| F(5% ≥ T/D > 4%) | | | |
| G(4% > T/D) | | — | |

In a region where the toner density T/D exceeds the proper range (region D in Table 1), a detection result as to variation in output image density is fed back to the development contrast potential. The development contrast potential is corrected so as to form images with excellent densities even when the toner replenishment is restricted as in the regions B and C as well as the regions E and F.

To this end, the image forming apparatus 100 has the image density sensor 12 for detecting the density of a reference toner image (patch image) which is formed for image density control on the photosensitive drum 1 by developing a reference electrostatic latent image (patch latent image) by the developing unit 4. Further, the image forming apparatus 100 has the toner density sensor 14 for detecting the toner density of developer in each developing unit 4. The image forming apparatus performs a toner replenishment operation for replenishing the developing unit 4 with toner from the toner replenishment unit 30 based on the result of detection by the image density sensor 12 or the toner density sensor 14.

The image forming apparatus 100 has the replenishment control restricted region as a developer toner density region where the toner replenishment operation is restricted based on the result of detection by the toner density sensor 14. Further, the image forming apparatus 100 has a normal replenishment region as a developer toner density region where the toner replenishment operation is not restricted based on the result of detection by the toner density sensor 14. In the image forming apparatus 100, when the toner density of developer in the developing unit 4, detected by the toner density sensor 14, falls within the replenishment control restricted region (toner density regions B, C, E, and F in Table 2), the development contrast potential is variably controlled based on the result of detection by the image density sensor (patch detection ATR sensor) 12.

The development contrast potential is obtained as a potential difference between the potential of a DC component of developing bias applied to the developing sleeve 41 and light area potential (image area potential) on the photosensitive drum 1. In the present embodiment, the development contrast potential Vcont is controlled by controlling a grid bias Vg to be applied to the grid of the primary charger 2 and a DC component Vdc of the developing bias to be applied to the developing sleeve 41 of the developing unit 4.

In short, in the present embodiment, the development contrast potential is changed by changing the charge potential of the photosensitive drum 1 and the potential of the developing sleeve 41. It should be noted that the method of controlling the development contrast potential is not limited to this, but another method executed e.g. by controlling laser power may be employed. Alternatively, the development contrast potential may be controlled by controlling either the grid bias Vg to be applied to the grid of the primary charger 2 or the DC component Vdc of the developing bias to be applied to the developing sleeve 41 of the developing unit 4.

In the present embodiment, in the case of increasing or reducing the development contrast potential, the CPU 111 of the controller 110 changes the grid bias Vg and the DC component Vdc according to the following equations (4) and (5):

$$Vg = Vg_ref + \alpha \times Vg_ref \quad (4)$$

$$Vdc = Vdc_ref + \alpha \times Vg_ref \quad (5)$$

Vg_ref: Vg before execution of development contrast potential control

Vdc_ref: Vdc before execution of development contrast potential control α: development contrast potential control index The development contrast potential control index α is added up as shown by the following equation (6):

$$\alpha = \text{preceding } \alpha + \text{present } \alpha \quad (6)$$

(α is an integrated value. Its initial value is 0.)

In the case of increasing the development contrast potential in the region B and the region C, the development contrast potential control index α is progressively increased. On the other hand, in the case of reducing the development contrast potential in the region E and the region F, the development contrast potential control index α is progressively increased in the negative direction.

The development contrast potential control index α is dependent on the result of the patch detection ATR. Therefore, by determining a change amount ΔDrate 2 in advance as a change in the result of the detection of the density of the patch image Q by the patch detection ATR, which occurs when each of the grid bias Vg and the DC component Vdc changes by 1 V, the CPU 111 determines the present α by the following equation (7) corresponding to the equation (2):

$$\text{present } \alpha = \Delta D / \Delta D\text{rate } 2 \quad (7)$$

On the other hand, the development contrast potential is brought back in the regions in Table 1 where normal toner replenishment is performed.

The normal toner replenishment is performed when it is determined by the patch detection ATR that image density is proper or thick in the region B and the region C and when it is determined that image density is proper or thin in the region D, the region E, and the region F. In these regions where the development contrast potential is to be brought back, the control is performed only in a direction of reducing the absolute value of the development contrast potential control index α. When the absolute value of the development contrast potential control index α is equal to 0, the development contrast potential is not changed. This is because when the toner density T/D is normal, it is required to hold the development contrast potential as constant as possible to thereby hold the development performance constant during execution of toner replenishment control. This makes constant the developing performance of developer, i.e. the toner charge amount, which prevents transferability of the developer from being changed.

However, in the control shown in Table 2, limit values (toner replenishment restriction limit values) for use in restricting toner replenishment and control switching limit values for use in switching between the development contrast control and the replenishment control, based on the patch density for image density detection, according to the state of toner density are set to the same values (an upper limit T/D of 11% and a lower limit T/D of 6%). The toner replenishment restriction limit values for use in restricting toner replenishment are set so as to prevent overflow of developer or fogging, or developer coating deficiency on the developer carrier, to thereby prevent degradation of image quality, and hence mechanical damage to the apparatus.

When the limit values (toner replenishment restriction limit values) for use in restricting toner replenishment and the control switching limit values for use in switching between the development contrast control and the replenishment control, based on the patch density for image density detection, according to the state of toner density are set to the same values, there arise the following problems:

Next, a description will be given, with reference to Table 3, of essential parts of the image forming apparatus 100 according to the present embodiment.

TABLE 3

| | RESULT OF PATCH DETECTION ATR | | |
|---|---|---|---|
| TONER DENSITY | THIN | PROPER | THICK |
| A(T/D > 13%) | | — | |
| B(13% ≥ T/D > 12%) | INCREASE | PROGRESSIVELY BRING | |
| C(12% ≥ T/D > 11%) | DEVELOPMENT | DEVELOPMENT | |
| D1(11% ≥ T/ | CONTRAST | CONTRAST BACK | |

TABLE 3-continued

| TONER DENSITY | RESULT OF PATCH DETECTION ATR THIN | PROPER | THICK |
|---|---|---|---|
| D > 10.9%) | | WHEN \|α\| > 0, BUT DO NOT CHANGE DEVELOPMENT CONTRAST WHEN \|α\| = 0 | |
| D2(10.9% ≥ T/D > 6.1%) | PROGRESSIVELY BRING DEVELOPMENT CONTRAST BACK WHEN \|α\| > 0, BUT DO NOT CHANGE DEVELOPMENT CONTRAST WHEN \|α\| = 0 | | |
| D3(6.1% ≥ T/D > 6%) | PROGRESSIVELY BRING DEVELOPMENT CONTRAST BACK WHEN \|α\| > 0, BUT DO NOT CHANGE DEVELOPMENT CONTRAST WHEN \|α\| = 0 | | REDUCE DEVELOPMENT CONTRAST |
| E(6% ≥ T/D > 5%) | | | |
| F(5% ≥ T/D > 4%) | | | |
| G(4% > T/D) | | — | |

As shown in Table 3, an upper control switching limit value (T/D value=10.9% in Table 3) for use in switching between the development contrast control and the replenishment control, based on the patch density for image density detection is set to be lower than an upper toner replenishment restriction limit value (T/D value=11% in Table 3) for use in restricting the toner replenishment. Further, a lower control switching limit value (T/D value=6.1% in Table 3) for use in switching between the development contrast control and the replenishment control, based on the patch density for image density detection is set to be higher than a lower toner replenishment restriction limit value (T/D value=6% in Table 3) for use in restricting the toner replenishment.

Next, a description will be given of a case where the two kinds of limit values are identical to each other, i.e. a case where the upper control switching limit value and the upper toner replenishment restriction limit value are equal to each other and the lower control switching limit value and lower toner replenishment restriction limit value are also equal to each other, and a case where the two kinds of limit values are different from each other.

Figure 9:
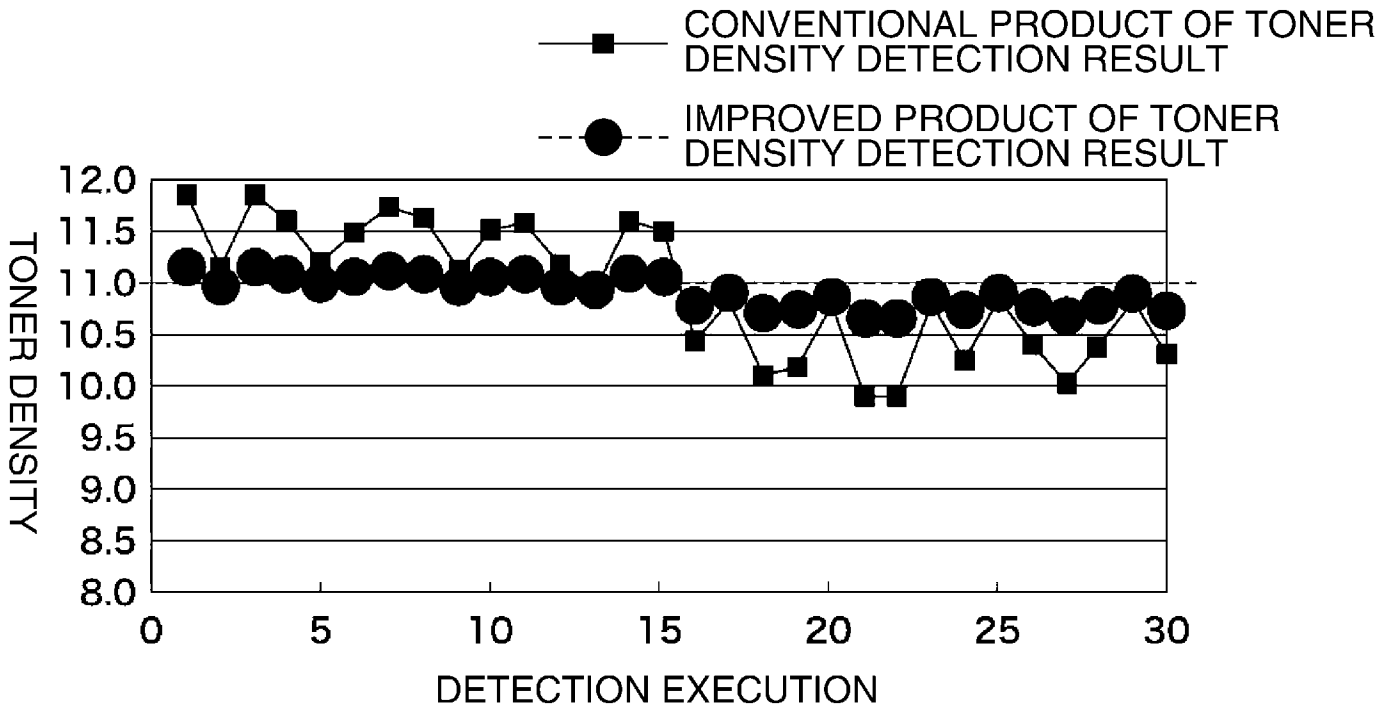
FIG. 9 is a graph showing a result of toner density detection by a conventional toner density sensor and a result of toner density detection by an improved toner density sensor.

FIG. 9 is a graph showing a result of toner density detection by a conventional product of the toner density sensor 14 and a result of toner density detection by an improved product of the toner density sensor 14. In FIG. 9, the limit of toner density is set to 11%. In this case, the conventional product detected the 11% or higher toner density fifteen times out of thirty times of the detecting operation. On the other hand, the improved product detected the 11% or higher toner density fifteen times only seven times. In other words, the use of the improved product of the toner density sensor made it possible to reduce by half the number of times of occurrence in which the detection result exceeds the limit value of toner replenishment.

1. Case where the Two Kinds of Limit Values are Identical to Each Other

Conventional Example

When the two kinds of limit values are identical to each other, the limit values are set as ones for use in restricting toner density control so as to prevent overflow of developer or fogging, or developer coating deficiency on the developer carrier to thereby prevent degradation of image quality and hence mechanical damage to the apparatus. This is because it is required to use a region where the toner charge amount can be made as constant as possible, maximum utilization of toner density is possible, and occurrence of mechanical damage can be prevented. It should be noted that in a case where the two kinds of limit values are identical to each other, problems described below occur wherever the limits are set.

Now, it is assumed that toner density changes in the vicinity of either of the restriction limits. In a state where toner density changes in the vicinity below the upper restriction limit, variation occurs in toner density detection as shown in FIG. 9. This means that there is a change in the frequency of the detection result exceeding the control switching limit value for use in switching between the development contrast control and the replenishment control, based on the patch density for image density detection.

In this case, as the variation in toner density detection is larger, the detection result more frequently exceeds the control switching limit value for use in switching between the development contrast control and the replenishment control. On the other hand, as the variation in toner density detection is smaller, the detection result less frequently exceeds the control switching limit value.

In a case where the control switching limit value is frequently exceeded, when it is detected, in a state where the control switching limit value has been exceeded, that the patch density for image density detection is thin, the detection result is frequently fed back to the development contrast to thereby correct image density as soon as possible.

On the other hand, in a case where the variation in toner density detection is small, the control switching limit value is less frequently exceeded, so that when it is detected that the patch density for image density detection is thin, the frequency of toner replenishment operation by the patch detection ATR is high. In the toner replenishment control by the patch detection ATR, there occurs not only does a time delay in feedback control, but also movement of toner in developer caused by toner replenishment, which takes time, and hence it takes longer before the effect of the control on an actual image appears than in the development contrast control. In the toner replenishment control by the patch detection ATR, since the development operation is continued during the time delay, consumption of toner advances, and charge-up of the toner charge amount easily occurs. As a consequence, in the toner replenishment control by the patch detection ATR, the amount of toner for development is reduced, which is likely to cause short-term reduction of image density.

As described above, when the toner replenishment restriction limit values for use in restricting the toner replenishment and the control switching limit values for use in switching between the development contrast control and the replenishment control, based on the patch density for image density detection are identical to each other, the density variation is more apt to occur depending on the magnitude of variation in toner density detection by the toner density sensor 14.

2. Case where the Two Kinds of Limit Values are not Identical

Present Embodiment

In a case where the two kinds of limit values are not identical to each other, the upper and lower toner replenishment restriction limit values set in association with a developer toner density in the developing unit 4, which was detected by the toner density sensor 14, so as to restrict toner replenishment are set to the same values as in the case where the two kinds of limit values are identical. This is because the limit values are determined from the viewpoint of preventing occurrence of an image defect.

On the other hand, the upper control switching limit value for use in switching between the development contrast control and the replenishment control, based on the patch density for image density detection is set to be lower than the upper toner replenishment restriction limit value for use in restricting the toner replenishment, so as to eliminate the inconvenience that the density variation is more apt to occur due to variation in toner density detection by the toner density sensor 14. Similarly, the lower control switching limit value for use in switching between the development contrast control and the replenishment control, based on the patch density for image density detection, is set to be higher than the lower toner replenishment restriction limit value for use in restricting the toner replenishment.

In the present embodiment, in order to eliminate the inconvenience that density variation is more apt to occur due to variation in toner density detection by the toner density sensor 14, the control switching limit value for use in switching between the development contrast control and the replenishment control, based on the patch density for image density detection are set, as shown in Table 3, such that the toner density falls within toner density detection variation (detection error range).

Next, a description will be given of control performed in a case where toner density changes in the vicinity of either of the restriction limits. When the toner density is in a state changing in the vicinity of the lower toner replenishment restriction limit value, the toner density is regarded to be within the toner density detection variation, whereby it is possible to increase the possibility of feeding back the detection result to the development contrast when the patch density for image density detection is detected to be thin. More specifically, in the control performed in this case, insofar as there is variation in the detected toner density, the control switching limit values for use in switching between development the contrast control and the replenishment control are not set to the same values as the toner replenishment restriction limit values for use in restricting the toner replenishment, but are set within the range of the toner density detection variation (i.e. within the detection error range).

Thus, in the control performed in the above-described case, it is possible to perform the development contrast control with an appropriate frequency. It should be noted that when a detected toner density T/D is in the region E or the region F, the control in the above-described case is performed to reduce the development contrast potential, i.e. in the direction opposite to the direction of the control performed to increase the development contrast potential when a detected toner density T/D is in the region C or the region B. However, the control methods executed in the two cases are substantially the same.

As described above, according to the present embodiment, it is possible to set the limits to toner replenishment control such that the toner density of the two-component developer does not exceed the proper range, to thereby prevent occurrence of overflow of developer or fogging, or developer coating deficiency on the developing sleeve 41. Further, when a detected toner density is in the vicinity of either of the limits of the proper range of toner density, the control switching limit values for use in switching between the development contrast control and the replenishment control are not set to the same values as the toner replenishment restriction limit values for use in restricting the toner replenishment, but are set within the range of the toner density detection variation. In this case, a detection result as to variation in the output image density obtained by detecting the density of the patch image Q is fed back to the development contrast potential.

Therefore, in the present embodiment, it is possible to secure developing performance and hence stability of image density and hue while preventing occurrence of overflow of developer or fogging, or deficiency on the developer carrier. Thus, the present embodiment makes it possible to achieve stability of image density in the replenishment control restricted region to thereby form a high-quality image.

It should be noted that in the present embodiment, the reference for setting the control switching limit values for use in switching between the development contrast control and the replenishment control according to the toner replenishment restriction limit values for use in restricting toner replenishment is set as follows:

It is desirable that the upper control switching limit value for switching the control corresponding to the upper toner replenishment restriction limit value for use in restricting the toner replenishment is set within the detection error range of the toner density detection sensor (tolerable error range). For example, the upper control switching limit value for switching the control is made lower than a value corresponding to the upper toner replenishment restriction limit value for use in restricting the toner replenishment by an amount corresponding to the minimum value of the error of the toner density detection sensor. This makes it possible to minimize the range of variation in the change amount of the toner density in the developing unit 4 to thereby achieve stability of the toner density.

Further, the lower control switching limit value for switching the control corresponding to the lower toner replenishment restriction limit value for use in restricting the toner replenishment is set in the same way as the upper control switching limit value described above.

Figure 5:
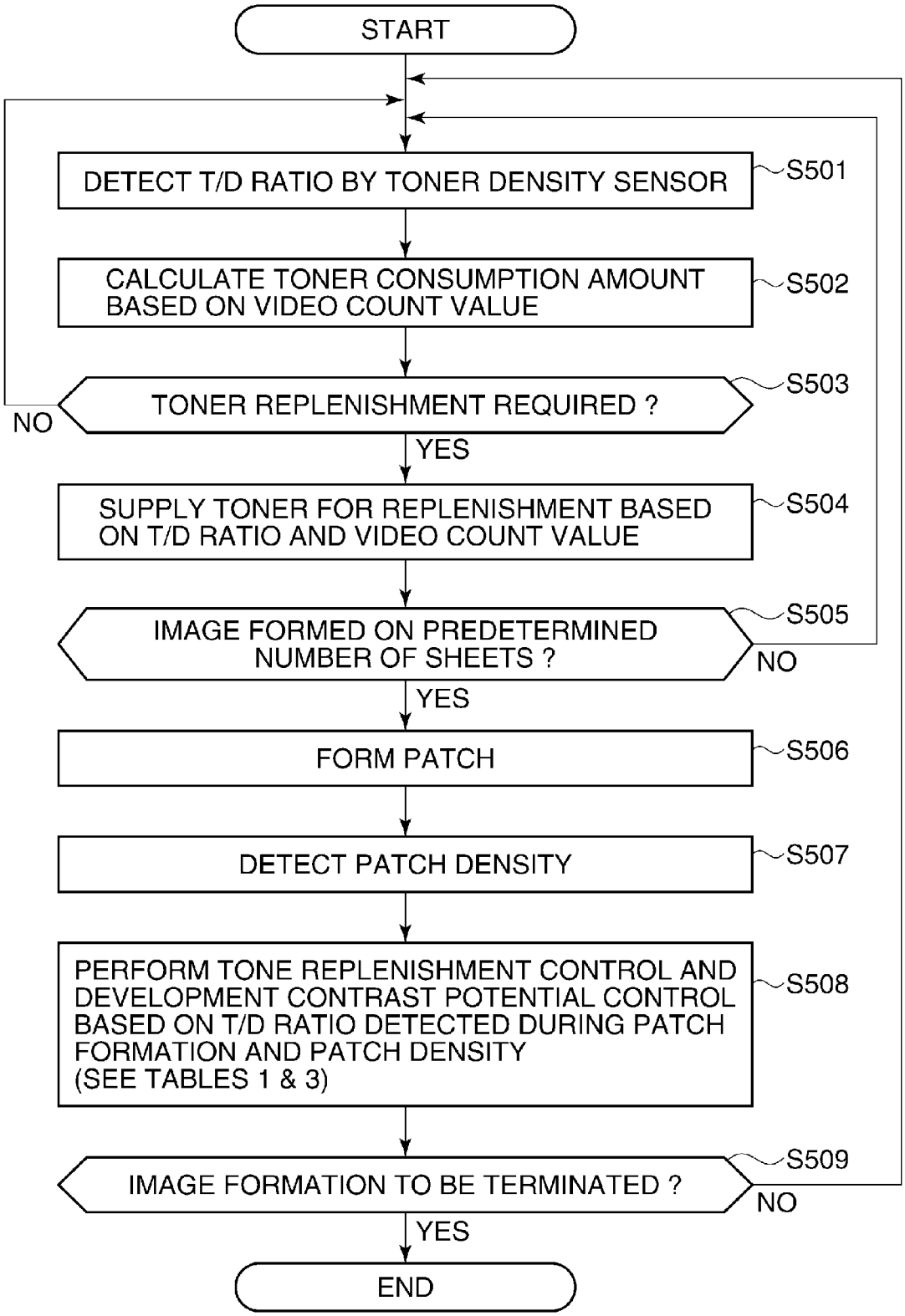
FIG. 5 is a flowchart of a control switching process executed by the image forming apparatus.

In the following, a description will be given of a control switching process for switching between the control of development contrast potential and the control of toner replenishment operation by the controller 110 of the image forming apparatus 100, with reference to FIG. 5.

This switching control process is executed by the controller 110 when the image forming apparatus performs image formation. When the image formation is started, the controller 110 compares the T/D ratio (toner/developer ratio) (step S501). Next, the controller 110 calculates a video count value from image data, and calculates a toner consumption amount from the video count value (step S502). Based on the detection result in the step S501 and the calculation result in the step S502, the controller determines whether or not toner replenishment is necessary (step S503). If it is determined in the step S503 that the toner replenishment is necessary, the controller 110 performs the toner replenishment by driving the toner conveyance screw 32 (step S504). In doing this, the toner replenishment amount is based on the T/D ratio and the video count value. If it is determined in the step S503 that the toner replenishment is not necessary, the controller 110 returns to the step S501.

Then, the controller 110 determines whether or not image formation has been executed on a predetermined number of (e.g. 24) sheets of recording material after the preceding formation of a patch (step S505). If it is determined in the step S505 that the image formation has not been executed on the predetermined number of sheets, the controller 110 returns to the step S501. On the other hand, if it is determined in the step S505 that the image formation has been executed on the predetermined number of sheets, the controller 110 forms the patch (step S507). Then, the controller 110 detects a density of the patch (step S507), and executes the toner replenishment control and the development contrast potential control based on the T/D ratio detected during the formation of the patch and the patch density (step S508). After the step S508, the controller 110 determines whether or not the image formation is to be terminated (step S509). If the image formation is to be continued, the controller 110 returns to the step S501, whereas if the image formation is to be terminated, the controller 110 terminates the present process.

Although the present invention is described heretofore based on the embodiment, by way of example, it is to be understood that the present invention is by no means limited to the above-described embodiment.

For example, in the above-described embodiment, toner images of respective different colors are sequentially formed on the single image bearing member, and then the toner images are sequentially transferred onto the intermediate transfer member in superimposed relation, whereby a full-color image is formed. However, this is not limitative, but the present invention can be applied to a so-called tandem-type image forming apparatus in which there are provided a plurality of image forming sections having respective image bearing members and toner images formed on the image bearing members of the respective image forming sections are sequentially transferred onto an intermediate transfer member.

Further, although in the above-described embodiment, the image forming apparatus is implemented by an intermediate transfer-type image forming apparatus having an intermediate transfer member, the present invention can also be applied to a direct transfer-type image forming apparatus having a transfer material bearing member. As is well known, the direct transfer-type image forming apparatus is configured to transfer one or more toner images formed on one or more image bearing members (photosensitive drums or the like) onto a transfer material carried on a conveyance belt or the like as a transfer material bearing member, to thereby form a monochrome or multi-color image.

The above-described embodiment provides advantageous effects in a color image forming apparatus which is capable of forming full-color images, but the present invention can also be applied to a monochrome image forming apparatus for forming monochrome images.

In the above-described embodiment, the toner density sensor 14 and the video counter 220 are used as the toner density detection unit. In this case, a detection result from the toner density sensor 14 is used for determination of the replenishment control restricted region (i.e. selection of a replenishment operation), and a detection result from the video counter 220 is used along with a detection result from the image density sensor 12, for calculation of the toner replenishment amount. However, this is not limitative, but only one of the toner density sensor 14 and the video counter 220 may be used as the toner density detection unit. For example, in a case where the toner density sensor 14 is used as the toner density detection unit, the toner replenishment amount is calculated based on the detection result from the toner density sensor 14 such that the toner density T/D becomes equal to a predetermined value. At the same time, a replenishment operation can be selected based on the detection result as in the above-described embodiment.

Similarly, in a case where the video counter 220 is used as the toner density detection unit, the toner replenishment amount is calculated based on a detection result from the video counter 220, as in the above-described embodiment, and the toner density T/D is calculated based on the detection result, whereby a replenishment operation is selected.

Although in the above-described embodiment, the image density sensor is configured to detect the density of a patch image on the photosensitive drum, this is not limitative. The density of the patch image may be detected after having been transferred onto a transfer member, such as an intermediate transfer member or a transfer material bearing member, where a toner image is transferred from the photosensitive drum.

Aspects of the present invention can also be realized by a computer of a system or apparatus (or devices such as a CPU or MPU) that reads out and executes a program recorded on a memory device to perform the functions of the above-described embodiment, and by a method, the steps of which are performed by a computer of a system or apparatus by, for example, reading out and executing a program recorded on a memory device to perform the functions of the above-described embodiment. For this purpose, the program is provided to the computer for example via a network or from a recording medium of various types serving as the memory device (e.g., computer-readable medium).

While the present invention has been described with reference to an exemplary embodiment, it is to be understood that the invention is not limited to the disclosed exemplary embodiment. The scope of the following claims is to be accorded the broadest interpretation so as to encompass all such modifications and equivalent structures and functions.

This application claims the benefit of Japanese Patent Application No. 2010-113126, filed May 17, 2010, and Japanese Patent Application No. 2011-104368, filed May 9, 2011, which are hereby incorporated by reference herein in their entirety.

What is claimed is:

1. An image forming apparatus comprising:

a photosensitive member;

an exposure unit configured to expose the photosensitive member based on image data in order to form an electrostatic latent image on the photosensitive member;

a developing device configured to supply toner to the electrostatic latent image on the photosensitive member by generating a potential difference between said developing device and the electrostatic latent image;

a toner replenishment unit configured to replenish the developing device with toner including a developer;

an image density detection unit configured to detect a density of a reference toner image which is formed by developing a reference electrostatic latent image, by said developing device;

a toner density detection unit configured to detect a toner density including developer in the developing device; and a control unit configured to control the developing device and the toner replenishment unit, wherein, in a case where the density of the reference toner image detected by the image density detection unit is less than a predetermined density and the toner density detected by the toner density detection unit is more than a first threshold value, the control unit controls the toner replenishment unit to replenish the toner based on the density of the reference toner image and controls the developing device to increase the potential difference, and wherein a limit value based on which the control unit controls the developing device to increase the potential difference is less than the first threshold value.

2. The image forming apparatus according to claim 1, wherein, in a case where the density of the reference toner image detected by the image density detection unit is more than the predetermined density and the toner density detected by the toner density detection unit is a second threshold value or less, the second threshold value being less than the first threshold value, the control unit controls the toner replenishment unit to replenish the toner based on the density of the reference toner image and controls the developing device to reduce the potential difference, and wherein the limit value based on which the control unit controls the developing device to increase the potential difference is more than the second threshold value.

* * * * *